United States Patent [19]

Watson

[11] 4,137,128

[45] Jan. 30, 1979

[54] BATTERY OF HORIZONTAL COKE OVENS AND METHOD FOR OPERATING THE SAME

[75] Inventor: Lewis A. Watson, Oldham, England

[73] Assignee: Dr. C. Otto & Comp. G.m.b.H., Bochum, Fed. Rep. of Germany

[21] Appl. No.: 779,631

[22] Filed: Mar. 21, 1977

[30] Foreign Application Priority Data

Mar. 19, 1976 [GB] United Kingdom ..... 11073/76

[51] Int. Cl.[2] ..... C10B 27/00; C10B 27/04; C10B 27/06

[52] U.S. Cl. ..... 202/256; 202/257; 202/259; 202/263

[58] Field of Search ..... 202/255-259, 202/263; 201/1, 45; 13/33; 266/159

[56] References Cited

U.S. PATENT DOCUMENTS

| | | | |
|---|---|---|---|
| 1,477,673 | 12/1923 | Suber et al. | 202/259 |
| 2,975,109 | 3/1961 | Van Ackeren | 202/255 |
| 3,537,957 | 11/1970 | Wagner et al. | 202/263 |
| 3,645,854 | 2/1972 | Calderon | 202/263 |
| 3,647,053 | 3/1972 | Palumbo | 201/1 |
| 3,767,536 | 10/1973 | Ikeda et al. | 202/263 |

FOREIGN PATENT DOCUMENTS

| | | | |
|---|---|---|---|
| 2406314 | 8/1975 | Fed. Rep. of Germany | 202/263 |

*Primary Examiner*—Morris O. Wolk
*Assistant Examiner*—Bradley R. Garris
*Attorney, Agent, or Firm*—Thomas H. Murray

[57] ABSTRACT

A battery of horizontal coke ovens which are connected to two gas-collecting mains extending alongside the battery, one of said mains having means for cleaning dust-laden gases emitted from the coke ovens during charging with coal without the use of a flushing liquor and incorporating means for inhibiting the condensation of tar-based matter in the gas. The invention also relates to a method for operating such a battery of horizontal coke ovens.

9 Claims, 2 Drawing Figures

BATTERY OF HORIZONTAL COKE OVENS AND METHOD FOR OPERATING THE SAME

BACKGROUND OF THE INVENTION

Figure 1:
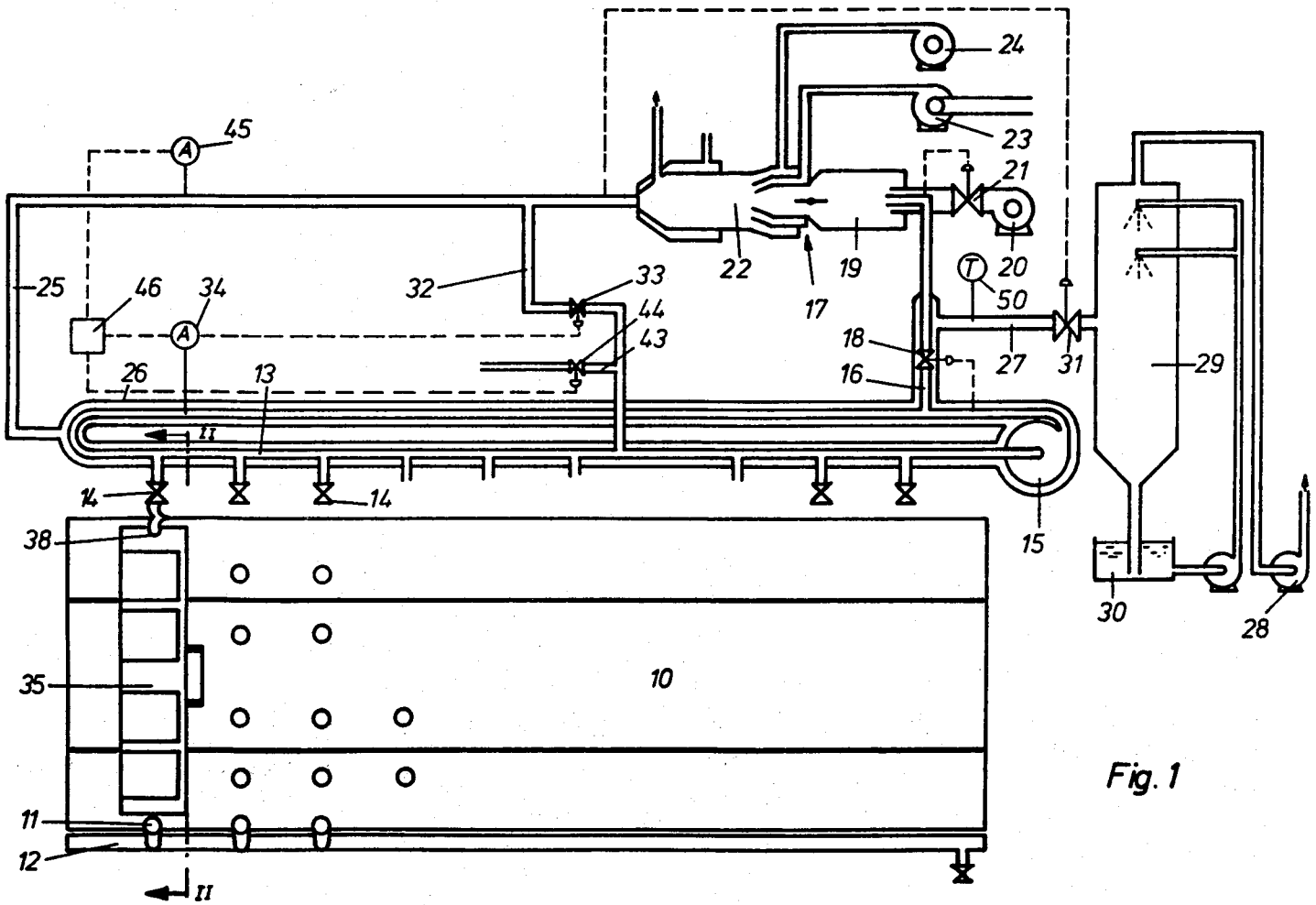

The coal for coking is preheated in many cases before it is charged into the ovens. This can be done for several reasons. There are various kinds of coal which do not yield sufficiently firm coke on degassing but which can provide coke of higher quality if they are charged after preheating. Another reason for preheating the coke is due to the preheated coke being carbonized in a shorter time. This means that a larger quantity of coke can be obtained from the same number of ovens. The capacity of a coking plant is, therefore, greater if the coal is preheated.

Charging preheated coal into the ovens encounters difficulties because the resulting gas contains substantial quantities of dust during charging and for some time thereafter. If these quantities of dust remain in the gas they militate against the further processing thereof. A second gas-collecting main has, therefore, been used in the past for drawing off the gases which are produced when the coal is charged. The operation of such a separate gas-collecting main, however, is difficult in view of the tarry constituents contained in the gas.

SUMMARY OF THE INVENTION

The object of the invention is the construction of a battery of horizontal coke ovens with a secondary gas-collecting main and a method for the operation thereof, the nuisance due to dust contained in the gases drawn off being eliminated to result in trouble-free operation.

According to the invention all ovens are connected not only to a gas-collecting main operated in the conventional manner but are also connected to a secondary off-gas collecting main which is provided with indirect heating and can thus be maintained at a temperature which is such that no gas constituents, more particularly tar products, are separated in the said secondary gas-collecting main. A temperature of at least 600° C. should prevail constantly in the secondary gas-collecting main. The gas is withdrawn from the said secondary gas-collecting main by means of a fan and a negative pressure between 80 and 400 mm WG is thus maintained to insure that there is no precipitation of dust.

The secondary gas-collecting main can be conducted in the form of a loop. The extraction of a part-stream of the gas is performed through a valve which insures that the desired negative pressure is maintained in the gas-collecting main.

According to the invention, the drawn off part-stream of gas is supplied to a combustion device. This comprises two serially-connected combustion chambers of which the first is provided with an air supply through a blower and a control valve and the second combustion chamber is provided with a blower for supplying fuel gas. The combustion device is operated so that the gas withdrawn from the secondary gas-collecting main is burnt with an excess of air in the first combustion chamber while the second combustion chamber is supplied with a quantity of gas which is such that the combustion products do not contain any excess of air. The amount of air supplied to the first combustion chamber is controlled by means of a regulating valve so that the quantity of air is proportional to the amount of gas supplied.

Furthermore, according to the invention, the secondary gas-collecting main, including its loop-shaped return, is incorporated into a casing, the interior of which is provided with supply means for a gaseous heating medium. The outlet of the above-mentioned combustion device can be connected to the casing through a duct. Indirect heating thus maintains the secondary gas-collecting main at the required temperature of at least 600° C.

The gas which is used as a heating medium and is obtained from the combustion device can be withdrawn from the casing by means of a blower and can be discharged to the atmosphere where appropriate. A scrubber, with liquid-circulating means, is connected upstream of the outlet.

Each of the ovens is to be connected at any time only to either the primary or the secondary gas-collecting main.

The oxygen content of the gas which flows through the secondary gas-collecting main as well as the oxygen content of the burnt gas discharged from the combustion device can be defined by built-in gas analysis apparatus. Burnt gas from the combustion device can be conducted to the secondary gas-collecting main if the oxygen content therein exceeds a specific amount; and provision can also be made for the supply of steam into the secondary gas-collecting main. Steam is introduced in controllable manner into the secondary gas-collecting main if the oxygen content of the gases discharged from the combustion device exceeds a predefined amount.

Figure 2:
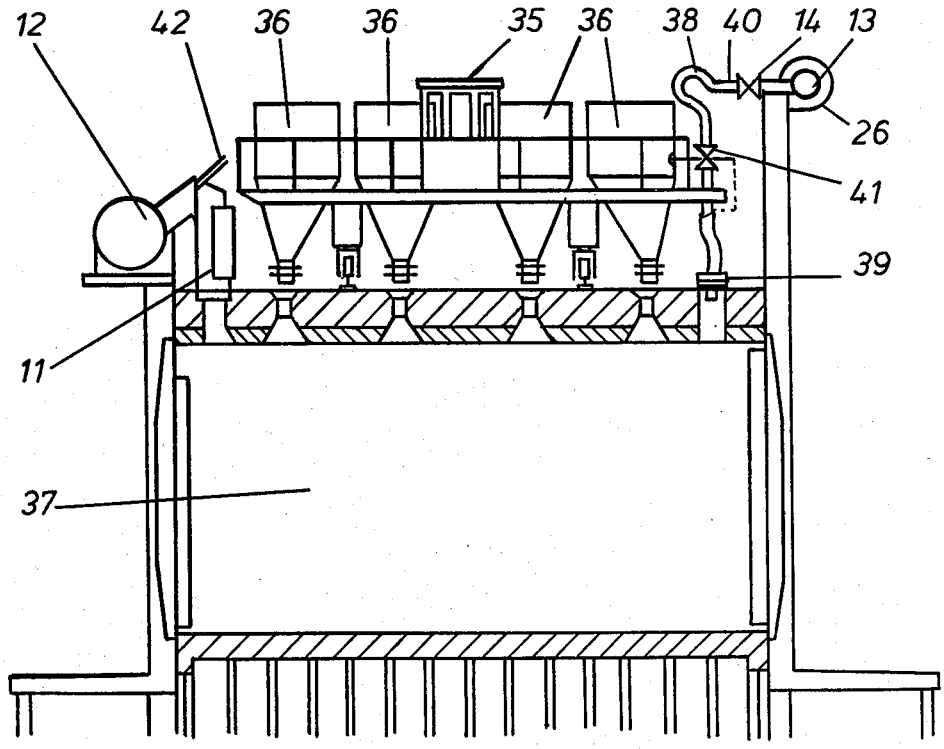

The subject of the invention will be explained by reference to the accompanying drawings, in which:

FIG. 1 is a plan view of a battery of horizontal coke ovens with a diagrammatic view of the secondary gas-collecting mains and of the apparatus in which the gas is treated; and FIG. 2 is a vertical section through the oven battery in accordance with the sectional line II—II of FIG. 1.

Referring to the drawings, there is provided a battery 10 of coke oven chambers. Connecting the chambers selectively and individually with a gas-collecting main 12 is a number of ascension pipes 11, one for each chamber, mounted on the oven top. A further gas-collecting main 13 is provided on the other side of the oven battery from the main 12, and consists of a continuous loop through which gases are circulated by a fan 15 therein. The fan insures that the suction conditions in the main 13 increase from −80 mm water gage to −400 mm water gage along the battery.

The main 13 is adapted for connection via a number of valves 14 selectively and individually to the chambers of the battery. The coal-charging car, to be described, travels along the top of the oven battery and serves to connect each chamber during charging thereof, to the main 13 via the associated valve 14.

Excess gases in the main 13 are extracted therefrom downstream of the fan 15 via a duct 16. The duct 16 includes a pressure control valve 18 whereby the pressure in the main 13 can be maintained at the desired level which, in this example, is 100 mm water gage at the point of take-off.

The gases are fed via the duct 16 to a combustion chamber generally indicated at 17 and comprising two combustion zones 19 and 22. The dust-laden gases from the main 13 are burned in the primary combustion zone 19 in the presence of an excess of air from a blower 20 via a valve 21. The valve 21 insures that the air supply to the zone 19 is proportional to the volume of gas in the duct 16.

It is important that the gases are burned in the zone 19 with an excess of air so that all of the noxious substances and particularly the dust contained therein are completely burned. However, it is then necessary to burn off the residual air derived from the excess. Therefore, the products of combustion from zone 19 are fed directly into the secondary combustion zone 22 where they are burned with clean coke oven gas from a blower 23 and, if necessary, some further air from a blower 24. Operation of the combustion chamber 17 is such that the final products of combustion are substantially free of oxygen.

The gases leave the chamber 17 at approximately 600° C.-800° C. and are fed via a duct 25 to a jacket 26 surrounding the loop main 13 so that the temperature therein is maintained at at least 600° C.

The jacket extends to surround the duct 16 through a substantial part of its length before being ducted at 27 to an induced draft fan 28 for exhausting the same to the atmosphere or, alternatively, to some storage means. A valve 31 in the duct 27 is connected to the output side of the combustion chamber 17 to maintain a pressure thereat of 25 mm water gage.

If required, a scrubber 29 for the gases can be inserted in the duct 27 upstream of the fan 28. The scrubber 29 feeds a settling tank 30 from which clean liquor is recirculated to the upper region of the scrubber in the normal way.

A transfer duct 32 is connected between the output side of the combustion chamber 17 and the loop main 13 on the suction side of the circulating fan 15. A valve 33 in the duct 32 is connected to a gas analyzer 34 adapted to sense the oxygen content of the gas in the main 13 such that if the oxygen exceeds 10%, then the valve 33 is opened and inert burnt gases are fed into the main 13 to purge the same. The valve 33 closes automatically as the oxygen level falls below 10%.

Referring now to FIG. 2, there is shown on top of an oven chamber 37, a coal-charging car 35 having a plurality of hoppers for feeding the oven. A pipe 38 mounted on the charging car 35 is connectable at 39 to each oven in turn being charged, and at 40, via the associated valve 14, to the main 13. A valve 41 is provided in the pipe 38 to maintain the pressure therein at approximately 5 mm water gage.

Valve means 42 are provided to insure that when the pipe 38 is connected to the main 13 then the ascension pipe 11 associated with the oven chamber being charged is disconnected from the collecting main 12.

A steam supply duct 43 (FIG. 1) having a valve 44 therein is connected to the line 32 to feed steam into the loop main 13. The valve 44 is controlled from a gas analyzer 45 adapted to sense a condition wherein the inert gases from the output side of the combustion chamber 17 have an oxygen content in excess of 5%. The analyzers 34 and 45 are connected to a device 46 which causes valve 44 to open when the oxygen content in the main 13 sensed by the analyzer 34 exceeds 10% and when the oxygen content in the duct 25 from the heat exchanger 17 simultaneously exceeds 5%. In such a condition, the arrangement previously described for opening valve 33 to allow the gases in the duct 25 to pass into the main 13 to purge the same is not suitable as these gases already exceed 5% oxygen content. Therefore, in these circumstances, the valve 33 is closed, or remains closed, and the valve 44 opens to allow steam to enter the loop main 13 to purge the same.

In use, therefore, the system is started up according to the following sequence: All charging valves 14 are closed and the circulating fan 15 is started up. The induced draft fan 28 is also started up, as is the air blower 20. The flow of air from the blower 20 into the first combustion zone 19 is controlled by the valve 21 in proportion to the flow of gas in the duct 16 so that during start-up conditions, only a small quantity of air passes into the primary combustion zone. The secondary combustion zone 22 is fired utilizing the air from the first combustion zone. After a flame has been established and the inert gases are directed into the system, the valve 33 is opened to allow the burnt gas to purge into the loop main 13 until an oxygen content below 10% is attained at which time the analyzer 34 senses the low oxygen content and causes the valve 33 to close. The temperature of the waste gases is monitored by the sensor 50 and when this has attained a level of 600° C., the charging of ovens can commence with gases flowing into the loop main 13.

It will be appreciated that the volume of circulating gas in the closed-loop main is such that any oxygen or air passing from an oven chamber can be easily absorbed without the danger of an explosive mixture being created in the main. Furthermore, as the temperature in the main is maintained at at least 600° C., there is no risk of condensation of tar-base matter in the main. Therefore, the main is kept completely dry, and the dust content of the gases is continuously circulated to prevent fall-out of dust.

It is not intended to limit the invention to the above examples only, many variations such as might readily occur to one skilled in the art being possible without departing from the scope of the invention.

For example, the pipe 38 interchangeably connecting the coke oven chambers one at a time with the loop main 13 can be carried on a separate trolley or car movable along the oven top. In this way, each oven chamber can remain in communication with the main 13 for a short period following charge while, for example, the charging car 35 returns to the end of the oven battery for refilling. This is particularly advantageous in cases where the coal being charged tends to emit dust-laden gases for a short period following charging.

I claim as my invention:

1. In a battery of horizontal coke ovens, a first gas-collecting main, first valve means for connecting each oven to said first main after that oven has been charged and the normal coking process proceeds, a second gas-collecting main in the form of a loop, second valve means for connecting each oven to said second gas-collecting main during the occurrence of dust in the off-gas from the oven due to charging of that oven, a fan for circulating off-gases in the loop, a first exit duct connected to the loop, a third valve in the first exit duct for regulating the passage of off-gases therethrough, means for burning at least a portion of the off-gases passing through said third valve, and means for indirectly heating said second main with the burned off gas to maintain the temperature in the second main at a level which will prevent condensation of tars in the off gas therein.

2. The apparatus of claim 1 wherein said loop-shaped second main is housed within a casing, and including means for supplying a gaseous heating medium to said casing whereby heat is transferred from said heating medium to the off-gases in the second main.

3. The apparatus of claim 2 wherein said first exit duct is connected to the inlet side of a combustion chamber means, and including means connecting the outlet side of said combustion chamber means to said casing.

4. The apparatus of claim 3 wherein said combustion chamber means comprises two serially-connected combustion chambers of which the first is provided with a forced air supply and the second is provided with a supply of fuel for combustion.

5. The apparatus of claim 2 wherein said casing is provided with a second exit duct, a blower in said second exit duct, and a control valve in said second exit duct.

6. The apparatus of claim 5 wherein said second exit duct for said casing includes a scrubber for gases passing therethrough.

7. The apparatus of claim 3 wherein the outlet of said combustion chamber is connected through a transfer duct to said second gas-collecting main, and including a control valve in said transfer duct.

8. The apparatus of claim 7 including first gas analysis apparatus for determining the oxygen content of the gas in said second main, and means for controlling said control valve in said transfer duct as a function of the oxygen content thus determined.

9. The apparatus of claim 8 including second gas analysis apparatus for determining the oxygen content of gases exiting said combustion chamber means, a valve device for controlling the introduction of steam into said second main, and control apparatus coupled to both of said first and second gas analysis apparatus for opening said valve device to introduce steam into said second main when the oxygen content of gases exiting from said combustion chamber means rises above a predetermined level while the oxygen content of gases in said second main rises above a second predetermined level.

* * * * *